United States Patent [19]

Roessiger

[11] Patent Number: 4,691,368

[45] Date of Patent: Sep. 1, 1987

[54] FLEXIBLE BLOCK PACKAGING

[75] Inventor: Claude Roessiger, Wolfeboro, N.H.

[73] Assignee: Ocor Products Corporation, Mirror Lake, N.H.

[21] Appl. No.: 746,978

[22] Filed: Jun. 20, 1985

[51] Int. Cl.[4] ..... B65D 33/16; B65D 30/18

[52] U.S. Cl. ..... 383/10; 383/93; 206/526

[58] Field of Search ..... 383/10, 67, 93, 95, 383/109, 111, 118, 122; 206/525, 526, 594, 524.9

[56] References Cited

U.S. PATENT DOCUMENTS

| | | | |
|---|---|---|---|
| 1,509,922 | 9/1924 | Belz | 383/109 |
| 2,112,406 | 3/1938 | Metro | 383/38 |
| 2,265,075 | 12/1941 | Knuetter | 383/122 |
| 3,093,295 | 6/1963 | Kugler | 383/67 |
| 3,145,908 | 8/1964 | Smith | 383/109 |
| 3,279,331 | 10/1966 | Platt | 383/95 |
| 3,502,258 | 3/1970 | Kugler et al. | 383/10 |
| 3,850,724 | 11/1974 | Lehmacher | 383/109 |
| 3,917,160 | 11/1975 | Olerud | 383/111 |
| 4,211,091 | 7/1980 | Campbell | 383/95 |

FOREIGN PATENT DOCUMENTS

| | | | |
|---|---|---|---|
| 2321474 | 4/1973 | Fed. Rep. of Germany | 383/10 |
| 2622659 | 12/1977 | Fed. Rep. of Germany | 383/10 |
| 1273157 | 5/1972 | United Kingdom | 383/10 |

*Primary Examiner*—Stephen Marcus

*Assistant Examiner*—Brenda J. Ehrhardt

*Attorney, Agent, or Firm*—Kenway & Jenney

[57] ABSTRACT

A flexible package that conforms closely to and fully encloses one or more objects with square or rectangular sides is formed of a flexible, light weight, and preferably heat sealable material such as a thermoplastic. In the preferred embodiments, the packaging is manufactured from tubular or parallel sheets of flexible thermoplastic material laid flat to form two layers, which are than folded into a U-shape with the band at the bottom and the side seams heat sealed to form an open topped, double walled package. The package specifications are determined from the dimensions and quantity of the objects to be packaged. Prior to sealing the sides of the package, the bottom portion of the material is tucked up between the sides to a distance equal to one-half the depth of the finished container so that when the objects are placed in the container, the bottom corners spread to form right angles. At a distance up from the bottom equal to the height of the finished package, internal sealing flaps are formed by cutting areas in the upper portion of the package inwardly for a distance equal to one-half the depth of the objects to be contained and upwardly for a distance equal to one-half the depth, plus an overlap. These fold over the contained objects to create a top with corners at right angles, without excess material at the sides. The flaps are sealed by means such as a strip of adhesive or double sided tape.

4 Claims, 7 Drawing Figures

FLEXIBLE BLOCK PACKAGING

BACKGROUND OF THE INVENTION

The present invention is generally in the field of packaging and in particular in the area of flexible packaging for objects with square or rectangular sides (rectilinear parallelepipeds).

There are a number of items which are packaged in multiple units for shipping and distribution for retail sale. Examples of such items include cartons of cigarettes, bottles of wine or alcohol in gift cartons, feminine hygiene needs, medical supplies, film, foodstuffs, candies and chocolates, and auto supplies. Up until the present time, these items have been packaged in either a cardboard carton, paper bag or in a flexible carrier which had to be heat sealed using a relatively complicated packaging operation with specially designed or installed equipment. These methods of packaging suffer from a number of disadvantages including (i) weight of the cartons, (ii) need for preassembly of the containers and then storage until loading, (iii) either specially designed and installed packaging equipment or several manual steps for sealing the carton, and (iv) a lack of a convenient way to handle the package when loaded, which does not interfere with storage. Paper bags such as those commonly used in grocery stores are light weight and easily stored, but they are closed only at the bottom. In addition, although the bottom forms a rectangular area when fully extended, it requires cutting, folding and pasting to form multiple layers.

It is therefore an object of the invention to provide a flexible package that holds and closely conforms to one or more rectangular or square sided objects.

It is another object of the present invention to provide a transparent, flexible package which can be used as a marketing tool and enhance customer perception of the contained goods.

It is a further object of the present invention to provide a rapidly manufactured, economical, lightweight, and easy to store container.

It is a still further object of the invention to provide a container with the foregoing advantages that also has handles which can be assembled as a part of the package, without addititonal processing steps or only minor modifications of the manufacturing process.

It is another object of the present invention to provide a flexible package which may be sealed on location after loading in a single, easy step.

SUMMARY OF THE INVENTION

A flexible package to enclose rectangular or square sided objects, either singly or in multiple units, which conforms closely to the dimensions of the contained object or objects. In the preferred embodiments, the packaging is manufactured from tubular or parallel sheets of flexible thermoplastic material laid flat to form two layers, which are then folded into a U-shape with the bend at the bottom and the side seams heat sealed to form an open topped, double walled package. The package specifications are determined from the dimensions and quantity of the objects to be packaged.

Prior to sealing the sides of the package, the bottom portion of the material is tucked up between the sides to a distance equal to one-half the depth of the finished package. With this construction, when the objects are placed in the package, the bottom corners spread to form right angles. At a distance up from the bottom equal to the height of the finished package, internal sealing flaps are formed by cutting slits in the upper portion of the package inwardly to a distance equal to one-half the depth of the finished packages and upwardly for a distance equal to one-half the finished package depth, plus an overlap. These sealing flaps fold over the contained objects to create a top with corners at right angles, without excess material at the sides. The flaps are sealed by means such as a strip of adhesive or double sided tape.

In the preferred embodiment, extensions of the outer wall extend upwardly over the internal flaps and are reinforced for use as handles. Handles may also be formed by heat sealing additional pieces of material to the sides of the packaging. Forming the handles contiguous with the sides of the package, as well as of the same flexible material, allows for ease in storage as well as manufacture. In alternate embodiments, the handles are formed of a separate rigid molded material and attached prior to loading.

DETAILED DESCRIPTION OF THE INVENTION

The present invention is a flexible package for use as a container for one or more rectangular or square sided objects and methods for its manufacture. The package is easily loaded and sealed using either manual or automatic techniques and transported by means either of handles constructed from the flexible material used for the body of the package, flexible material reinforced and attached at the top of the package, or a rigid molded plastic.

In general, the package is manufactured by folding flexible material, wherein the width of the material is equal to the width of the finished package plus the depth of the finished package, to form a double-walled U-shape, tucking the bottom of the "U" up between the two pieces to a distance equal to one-half the depth of the finished package, cutting the top sides of the inner wall of the package, beginning at a distance up from the bottom equal to the height of the finished package, continuing inward to a distance equal to one-half the depth of the finished package, turning at a right angle and continuing upwardly for a distance equal to one-half the depth of the finished package plus an overlap until the piece is cut out, to form the internal flaps, and then adding a piece to or processing the outer wall to form handles on both sides of the package.

To make the entire package double walled, flexible film that is tubular, either extruded as such or created from a single flat sheet by folding and longitudinal sealing, is itself treated as a flat sheet which is folded and heat sealed. The double wall may also be formed by lay flat sheeting. With lay flat sheeting, the edges are folded in to create the double wall effect just at the top of the bag. The internal flaps can also be formed by sealing or gluing two parallel bands of material at the edges of the lay flat sheet.

Generally, the flexible material will be dimensioned to result in a package which, in cooperation with the features noted above, closely conforms to the shape of the object or objects to be contained. In particular, the dimensions of the bottom portion of the package must be well controlled so that bunching of excess material does not result from an improper fit at each of the four corners. The internal flaps must also be carefully dimensioned so that they may fold over each other and be sealed without excess or insufficient material.

As shown in FIGS. 1–7, the package may be embodied in a number of different forms, each of which incorporates the key features of the internal sealing flaps and tucks which fold out to create right angled corners at the bottom of the package.

Figure 1:
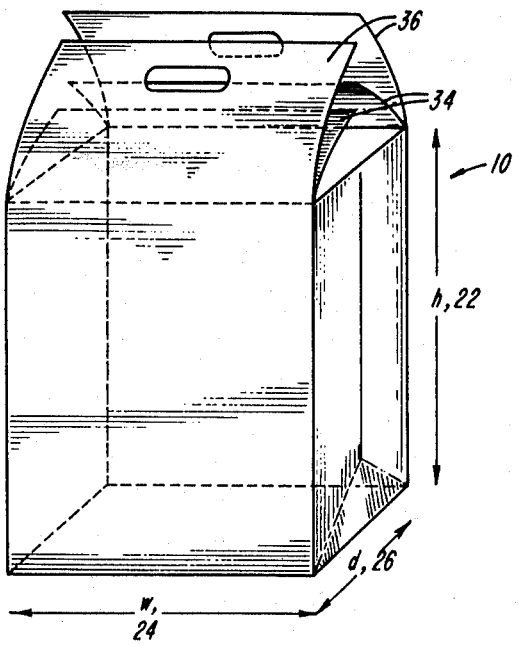
FIG. 1 is a perspective view of one embodiment of the flexible package according to the present invention.
Figure 2:
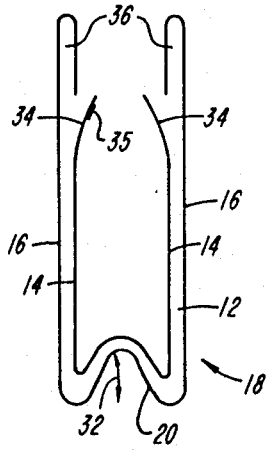
FIG. 2 is a cross sectional view taken along line 2—2 of the package of FIG. 1.
Figure 3:
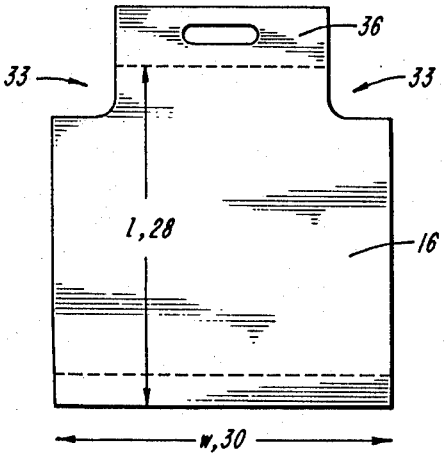
FIG. 3 is a view in side elevation of a side wall of the package of FIG. 1.

As shown in FIGS. 1–3, a double-walled package 10 is made from tubular flexible material 12, laid flat so that two sheets 14, 16 are adjacent each other, and folded into a U-shape, as is best seen in FIG. 2. A "bottom" portion 20 of the U is tucked up and between the legs of the U. The sides are then heat sealed to a height equal to the height of the finished package to form a tubular bag 18 (FIG. 2). The depth of the tuck is proportioned so that when an object or objects inserted in the bag 18 pushes the tuck downwardly, the tuck flattens into a bottom with right angles formed at each of the four corners, as is best seen in FIG. 1. It is necessary to determine the height 22, width 24 and depth 26 of the finished package based on the dimensions of the object or group of objects which will be placed in the package in order to determine the length 28 and width 30 of the pieces 14, 16 and depth 32 of the tuck 20. The upper corners of the two inside pieces 14 of the tubular bag 18 are cut away to form internal sealing flaps 34 which can be folded across each other to form a top for the packaging. The cutouts in the inner piece are formed by a lateral cut equal to one-half the depth 26 and a longitudinal cut equal to one-half the depth plus the distance the sealing flaps overlap.

The internal flaps 34 may be sealed by one or more single or double sided adhesive tapes 35, cross hatching, perforation, or by mechanical means such as by stitching or stapling. One advantage is that the package is thereby made tamper proof.

Cutouts indicated generally at 33, 33 may be made in the outer pieces 16 of material to form handles 36, either with or without reinforcing. The material may be reinforced by addition of another piece of material or cross hatching. Handles formed from rigid molded plastic or conventional hanger or hook type handles may also be used. If the outer pieces 16 are to be made into handles, the length 28 of the pieces 16 must be extended to provide the necessary material.

Any flexible material may be used in the manufacture of the package, including thermoplastics, paper, woven polyolefins, woven thermoplastics, and laminates of such materials. In the preferred embodiment, a transparent flexible plastic material is used.

Figure 4:
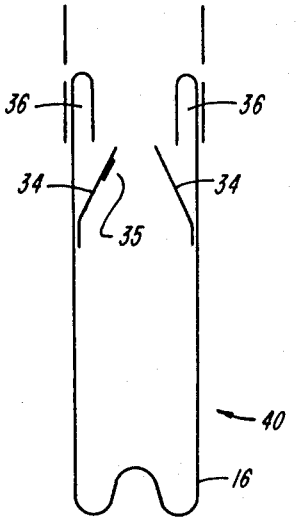
FIG. 4 is a cross sectional view of an alternative embodiment of the invention utilizing a single-walled construction.

As shown in cross section in FIG. 4, a second embodiment 40 of the package eliminates the internal wall 14 extending throughout the interior of the package 10. The double wall is limited to the upper portion of the package 40 where it forms the sealing flaps 34 and handles 36. The internal flaps 34 at the top of the package are formed either by folding a flat sheet of material over the edges of the bag and heat sealing it to the sheet 16, or by applying, in parallel on each edge of the wider sheet 16, a separate narrower sheet. Eliminating the internal wall from the majority of the package saves about 30% of the total material required to make the package.

Figure 5:
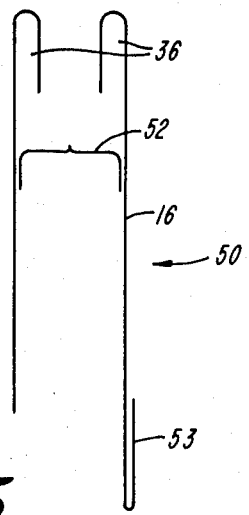
FIG. 5 is a cross sectional view of another single-walled package according to the present invention with an open bottom and sealed top.

In a third version 50 of the package, shown in cross section in FIG. 5, the package is loaded and sealed using fully automatic bottom loading technology. The bottom 52 is formed as described with reference to the bottom 20 in the first embodiment 10, shown in FIGS. 1–3. As shown, therefore the "bottom" is actually at the upper end of the package. To avoid confusion, therefore, for the purposes of this description "bottom" is defined as the end towards which the product is inserted. The package is loaded using fully automatic equipment known to those skilled in the art. There is a variety of known systems, such as wicketing, "four-flap folding", and the "Joker System", which is the proprietary technology of Schur Plastics A/S, Denmark. After loading, the "top" 53 is folded and sealed using conventional techniques.

Figure 7:
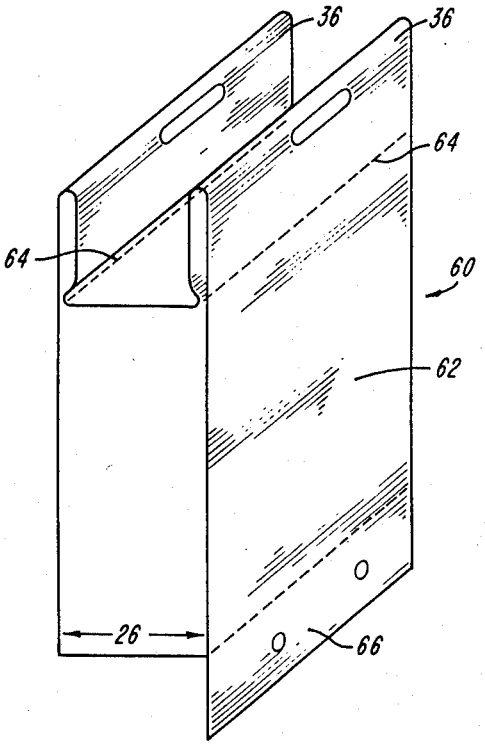
FIG. 7 is a cross sectional perspective view of the package of FIG. 6 taken along line 7—7 to the line 7A—7A.
Figure 6:
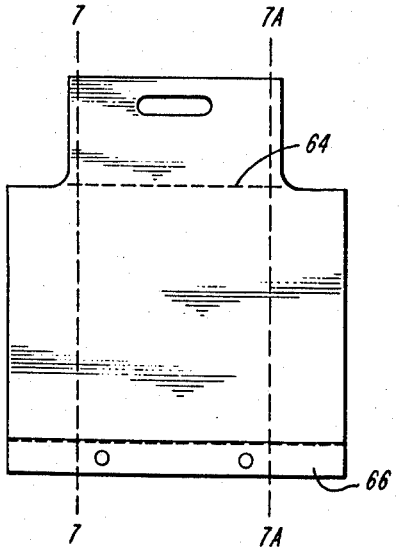
FIG. 6 is a view in side elevation prior to loading of another single-walled embodiment suitable for automatic manufacture.

As shown in FIGS. 6 and 7, a second package 60, also loaded using automatic technology, is shown with a tear-away section 66 of flexible material for use with automatic wicketing technology. This embodiment 60 can also be made from a single sheet 62 of material. The appropriate cutouts are made at the top and bottom, the material folded in a generally U-shape with the bend at the top to form the "bottom", leaving sufficient material so as to provide a quantity of sheet 62 equivalent to the desired depth 26 of the package across the width of the package 60, and parallel seams 64 made by heat sealing to form handles 36. The section 66 is torn away during loading using conventional techniques and the "top" folded and sealed, as described with reference to the other embodiments.

The present invention and further modifications and variations of the packaging and method of packaging will occur to those skilled in the art from the foregoing detailed description and accompanying drawings. These modifications and variations are intended to fall within the scope of the appended claims.

I claim:

1. A flexible package for containing rectangular or square sided objects in a closely conforming relationship comprising:

a double layer of flexible material formed in a "U" shape with one layer forming an inner wall and the other layer forming an outer wall, wherein the bottom of the "U" is tucked up between the two sides of the "U" to a distance equal to one half the desired depth of the finished package and the edges of the sides of the "U" are secured together, including the edges of the tucked up portion, to form a package open at its top end only, said edge sealed tucked in portion, when expanded to surround the objects held in the package, forming a generally flat, rectilinear bottom portion, integral upper portions of said inner wall extending beyond the upper ends of the combined height of the objects to be contained to form sealing flaps that can be folded across the top portion of the finished package to enclose the top end of the package in said closely conforming relationship when it is fully loaded with the objects, and integral upper portions of said outer wall extending beyond the upper ends of said combined objects to form handles.

2. The package of claim 1 wherein said double layer flexible material comprises a tubular sheet laid flat.

3. The flexible package of claim 1 further comprising means of sealing the sealing flaps to each other.

4. The flexible package of claim 1 wherein said flexible material is transparent plastic material.

* * * * *